United States Patent [19]

Kempster

[11] 3,960,634

[45] June 1, 1976

[54] METHOD OF MAKING RECORDS

[76] Inventor: George A. Kempster, 47 W. Elm St., Brockton, Mass. 02401

[22] Filed: June 19, 1975

[21] Appl. No.: 588,419

Related U.S. Application Data

[63] Continuation of Ser. No. 380,058, July 17, 1973, abandoned.

[52] U.S. Cl. ..... 156/277; 156/300; 283/6; 283/66 A; 355/77

[51] Int. Cl.[2] ..... B42D 12/02

[58] Field of Search ..... 156/309, 227, 277, 297, 156/299, 300; 283/66 R, 66 A, 6; 355/77, 133; 40/102, 104.3, 158, 125 A, 5; 346/85, 104

[56] References Cited

UNITED STATES PATENTS

| | | | |
|---|---|---|---|
| 3,126,211 | 3/1964 | Hieken et al. | 283/6 |
| 3,250,456 | 5/1966 | Schuessler | 283/66 R |
| 3,661,407 | 5/1972 | Warren | 283/66 R |
| 3,823,963 | 7/1974 | Fitzgerald et al. | 283/66 R |

*Primary Examiner*—William A. Powell
*Assistant Examiner*—Jerome Massie

[57] ABSTRACT

A master sheet bears on its face permanent indicia identifying a doctor and a patient, and an extension sheet has provision for recording service performed by a doctor for a patient. This extension sheet is adhesively united to said master sheet below said permanent indicia, and when additional service is performed for a patient, another extension sheet is used to record said service and said other extension sheet is adhesively united to said master sheet directly over the first-mentioned sheet. As each service is recorded a copy is made and kept by the doctor, or some one else.

1 Claim, 4 Drawing Figures

METHOD OF MAKING RECORDS

This application is a continuation of Ser. No. 380,058, filed July 17, 1973, now abandoned.

My principal object is to provide a complete record of each service performed for a patient, without having to write the patient's name and other indicia, as well as the doctor's name and indicia, more than once, thus saving time and avoiding the mistakes which are quite possible to occur if the basic indicia about a patient has to be written or typed over and over again as each service is performed.

The foregoing and other objects, which will appear as the nature of the invention is better understood, may be accomplished by a method of using such as is disclosed by the specification and drawing. The nature of the invention is such as to render it susceptible to various changes and modifications, and therefore, I am not to be limited to the construction disclosed by the drawing, nor to the particular parts described in the specification; but am entitled to all such changes therefrom as fall within the scope of my invention.

Figure 1:
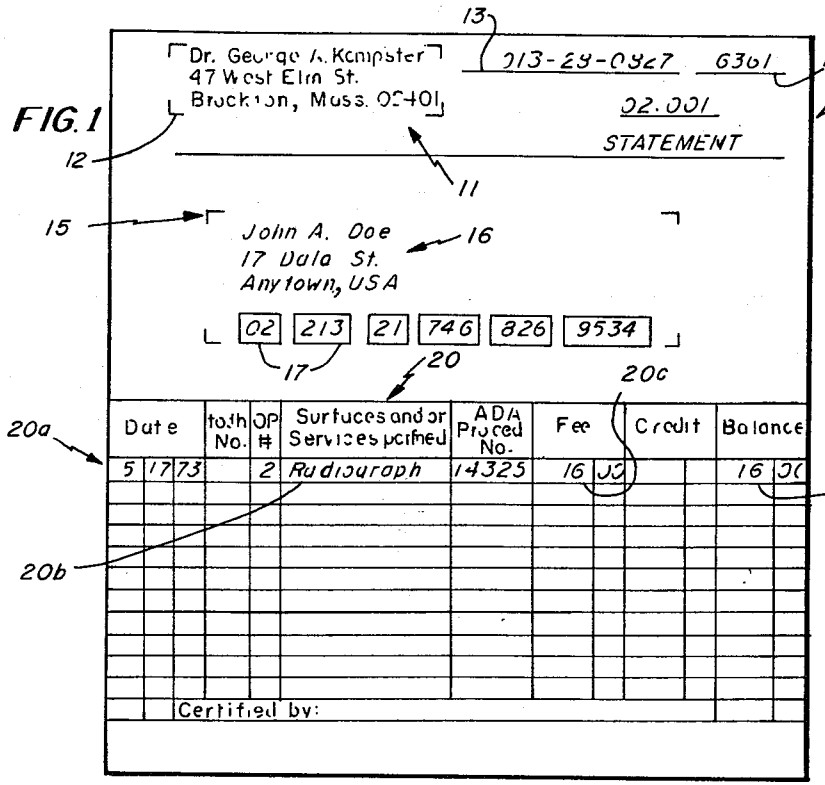
FIG. 1 is a plan view of a master sheet on which indicia of a doctor and his patient appear and also information as to services first performed by said doctor for said patient.
Figure 2:
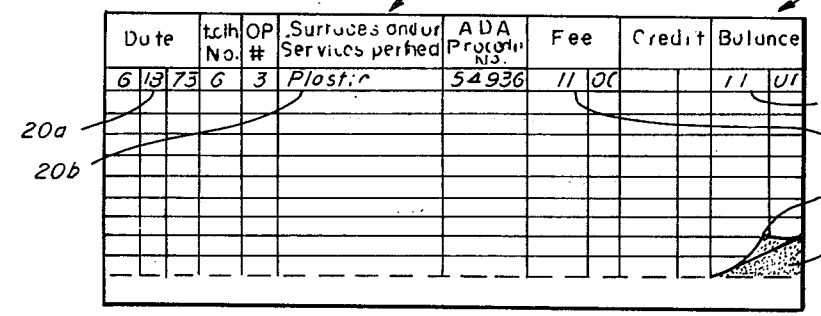
FIG. 2 is a plan view of an extension sheet on which provision is made by headed columns for recording information as to other services performed by said doctor for said patient, the top face portion being turned up at a corner thereof to show an adhesive bearing portion below it.
Figure 3:
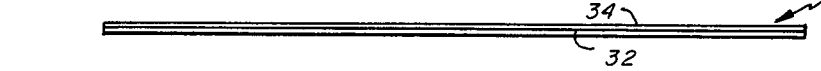
FIG. 3 is an edge elevational view of the extension sheet shown in said FIG. 2.

As illustrated, a master card or sheet 10 has data 11 of a physician or a dentist, hereinafter referred to as a doctor. In the upper left corner portion is the name and address 12 of a doctor that performs the service. In the upper right corner is his Social Security number 13 and his license number 14, and similar information.

Below the above information is incidia or data 15 of a patient such as his name and address 16 and his identifying number 17 (used in welfare cases) or his insurance number. The above is permanent, essential information.

Below the above is indicia or information of the first services performed 20 such as the date of said service

20*a*, type of service 20*b*, the fee charged 20*c* and the balance 20*d* owed. Other information may also be included if desired to identify further service performed. This information is in columns.

Since a patient will return for more service, it is expected, therefore, a copy of the master card 10 is made and kept by the doctor or an insurance company, or a welfare department.

In performing the next service for the same patient a supplemental or extension card 30 is provided which carries adhesive 32 and preferably a removable cover 34 that protects the latter until it is used.

This supplemental or extension sheet 30 has provision for information in columns of services performed 36, similar to said information 20 on card 10, the different services being given numerals 20*a*, 20*b*, 20*c*, 20*d*, since provision for the information is the same as said indicia 20.

Figure 4:
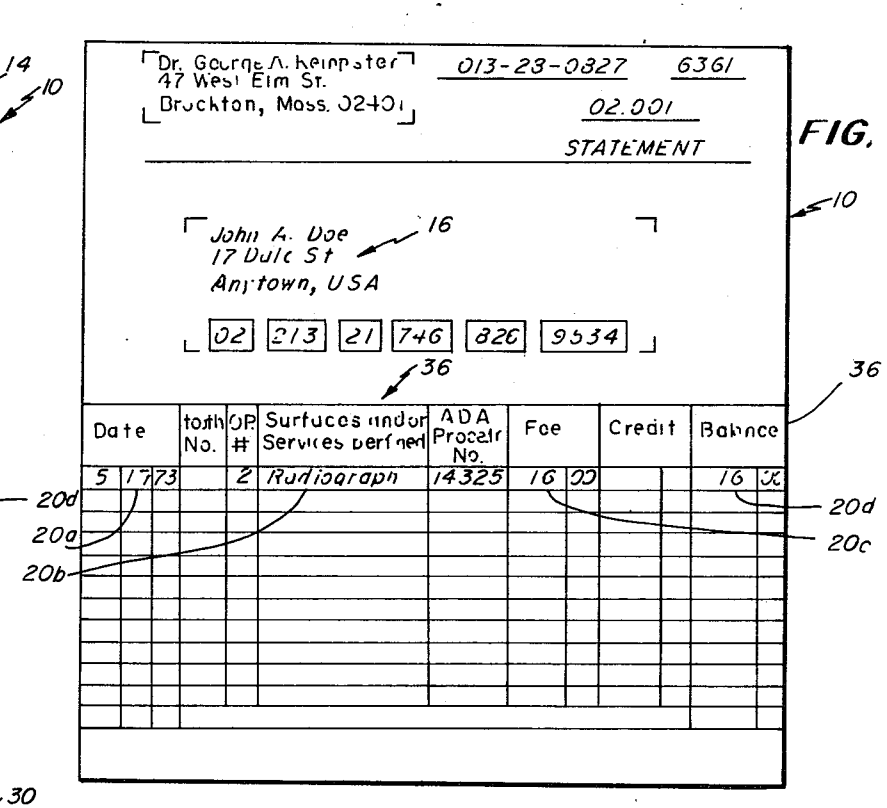
FIG. 4 is a plan view showing said extension sheet attached to and in position of use on said master sheet.
Figure 5:
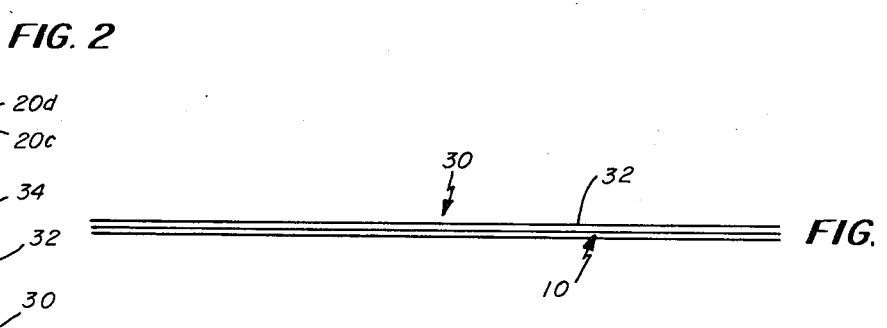
FIG. 5 is an edge elevational view of the combined extension sheet and master sheet shown in FIG. 4.

This supplemental or extension card 30 is placed on said master sheet 10 just above the provision for services performed 20, as shown in said FIG. 4, matching column for column, using the portion of the master card 10 above the latter provision 20 to supply the same essential information.

The whole assembly of said sheet 10 and extension sheet 30 is photo-copied and sent to welfare office or other depositary of this information.

Should another service be performed another extension sheet such as 30, is filled out, as explained above, and it is placed on said master sheet 10 over the extension sheet 30 already on there, which method step may be repeated every time a service is performed.

I claim:

1. A method of making records that consists of the steps of providing a master sheet including a top portion having permanent indicia identifying a doctor and a patient and a bottom section having an area of permanent indicia establishing lengthwise columns for use in recording services performed by the doctor, photocopying said master sheet after performed services are recorded thereon, providing an extension sheet of the size and shape as said area and having identical indicia on its face for recording services subsequently performed by the doctor for the identified patient, and then, before the recording of said subsequent services, adhesively securing said extension sheet on said bottom portion in a position in which its indicia is an exact replacement of the now covered area, and thereafter photocopying the modified master sheet with the copy appearing as that of a first used master sheet.

* * * * *